United States Patent [19]

Muzslay

[11] Patent Number: 4,959,027

[45] Date of Patent: Sep. 25, 1990

[54] FUEL INJECTOR ADAPTOR

[75] Inventor: Steven Z. Muzslay, Huntington Beach, Calif.

[73] Assignee: ITT Corporation, New York, N.Y.

[21] Appl. No.: 481,409

[22] Filed: Feb. 20, 1990

[51] Int. Cl.[5] ..... H01R 25/00

[52] U.S. Cl. ..... 439/655; 439/883; 29/832

[58] Field of Search ..... 439/854, 855, 867, 868, 439/883, 860, 638–655, 620, 907, 915; 29/832, 834, 836, 837, 838, 842

[56] References Cited

U.S. PATENT DOCUMENTS

| | | | |
|---|---|---|---|
| 3,312,931 | 4/1967 | Keller | 439/855 |
| 3,377,613 | 4/1968 | Archer | 439/651 |
| 3,867,001 | 2/1975 | Hedman | 439/638 |
| 3,997,225 | 12/1976 | Horwinski | 439/652 |
| 4,225,206 | 9/1980 | Roman, Jr. | 339/91 |
| 4,430,983 | 2/1984 | Hagen | 439/638 |
| 4,732,546 | 3/1988 | Fehlmann et al. | 417/289 |
| 4,792,307 | 12/1988 | Stewart, Sr. | 439/26 |
| 4,810,205 | 3/1989 | O'Grady | 430/350 |

*Primary Examiner*—David L. Pirlot
*Attorney, Agent, or Firm*—Thomas L. Peterson

[57] ABSTRACT

An adaptor is provided that can be mounted on a typical straight fuel injector having narrowly-spaced upwardly projecting terminals, so the straight injector can be used in place of an inclined injector which has widely spaced terminals projecting at a 45° incline from the vertical. The adaptor includes a housing (40) with a lower part that opens along a downward axis (44) and an upper part that opens along an upwardly inclined axis (50). A pair of bent plate-like contacts (52, 54) are mounted in the housing, with each contact having an upper part (56) lying within the upper housing part and extending along the inclined axis, and a lower contact part (60) lying in the lower housing part and extending perpendicular to the downward axis. The lower housing part is permanently mounted on an upper end of the injector body, with the injector terminals (24) projecting through holes in the contact lower parts to hold the contact securely in position.

11 Claims, 3 Drawing Sheets

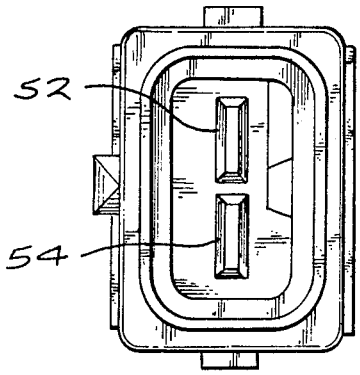
FIG. 3
FIG. 4
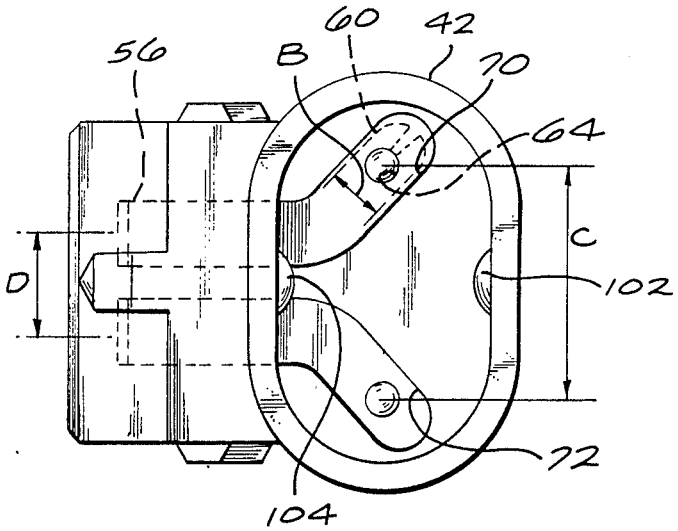

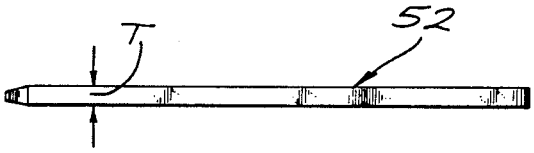
FIG. 5
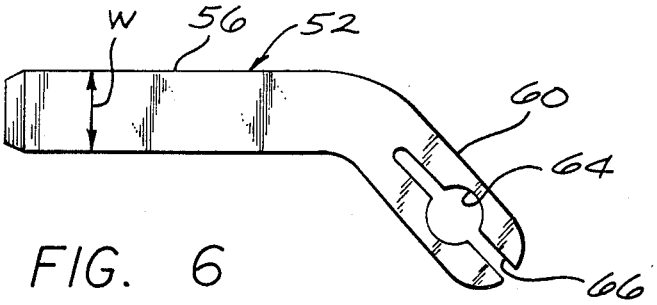
FIG. 6
FIG. 7
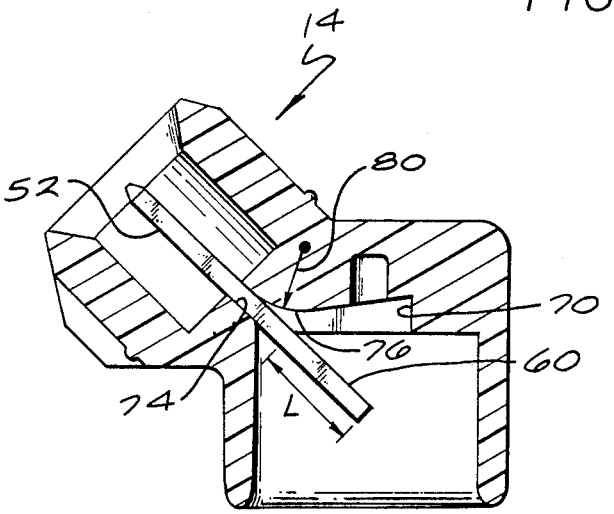

FUEL INJECTOR ADAPTOR

BACKGROUND OF THE INVENTION

Two major types of fuel injectors are the straight type which has upwardly projecting terminals and the right angle type which has terminals projecting at a 45° incline from the vertical. Straight type injectors can be used in place of inclined projectors, except that the inclined harness connectors must be mounted at an incline from the vertical because there is no room directly over the injector for the harness connector. Also, the inclined harness connector terminals for the inclined injector are more widely spaced than those for the straight injector. An adaptor for adapting the straight terminal so it can be connected to an inclined connector, which was of simple construction and low cost, and which could withstand the hot environment near an engine, would be of considerable value.

SUMMARY OF THE INVENTION

In accordance with one embodiment of the present invention, a fuel injector adaptor is provided, for adapting a straight injector for use with a connector designed for an inclined injector, which is of simple and reliable construction. The adaptor includes a housing with a lower part that opens along a downward first axis and an upper part that opens along an upwardly inclined second axis. A pair of contacts lie in the housing, each contact having a substantially straight upper contact part lying in the upper housing part and extending along the inclined axis, and a lower contact part lying in the lower housing part and extending substantially perpendicular to the downward axis. Each contact is in the form of a bent plate with a hole in the lower contact part. The-lower housing part is permanently mounted on the top end of an injector body, with the upstanding terminals of the injector projecting through the holes in the contact lower parts. The injector terminals help to hold the contacts securely in position, so they can resist mating and unmating forces of a connector on the inclined adaptor part.

The lower housing part is locked to the injector body by first mating the lower housing part with the adaptor body end. Then opposite sides of the lower housing part are deformed into adjusting holes in the injector body upper end. The contacts are initially in the form of flat plates, and are bent only after they are installed in the adaptor housing.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on the line 3—3 of FIG. 2.

FIG. 4 is a view taken on the line 4—4 of FIG. 2, but showing only the adaptor, and without the locking and sealing plates thereof.

FIG. 5 is a side elevation view of a contact of the connector of FIG. 2, shown prior to bending of it.

FIG. 6 is a plan view of the connector of FIG. 5.

FIG. 7 is a sectional view of the adaptor housing of FIG. 2, shown with contacts after they are initially installed but prior to bending of them.

DESCRIPTION OF THE PREFERRED EMBODIMENT

Figure 1:
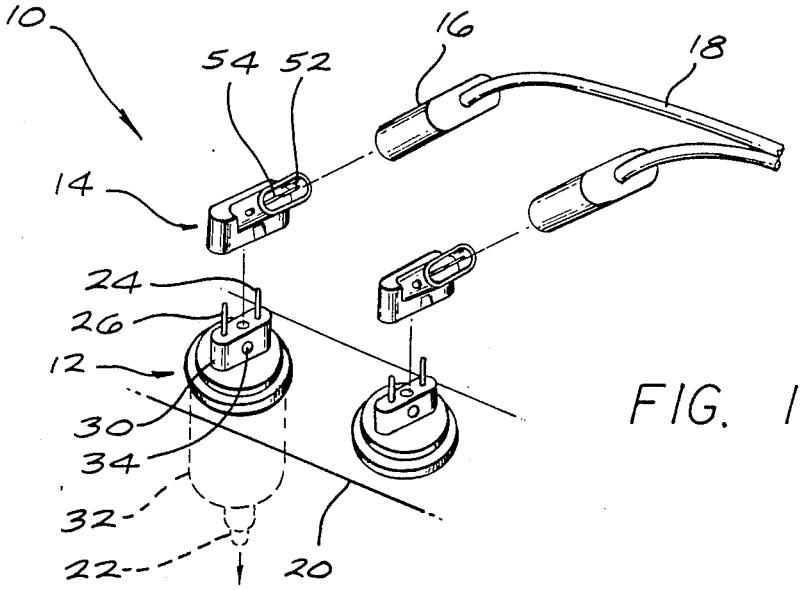
FIG. 1 is an exploded perspective view of a portion of the fuel injection region of an engine, showing adaptors constructed in accordance with the present invention.

FIG. 1 illustrates a portion of a fuel injector system 10 of the present invention, which includes straight fuel injectors 12, adaptors 14 for mounting on the injectors, and connectors 16 on a harness 18 for connecting to the adaptors 14. The fuel injectors 12 lie on a fuel rail 20 that supplies pressured fuel to each injector for injecting through an outlet 22 into an engine cylinder. Electrical signals received over injector terminals 24, 26 control the injection of fuel. The terminals project upwardly from an insulative body end 30 of the injector body 32. The particular fuel injectors are of the straight injector type, wherein the terminals 24, 26 project upwardly perpendicular to the length of the fuel rail 20. It should be noted that the body end 30 has adjusting holes 34 at its opposite sides, which are used to adjust each injector during its manufacture, but which thereafter have not been previously used.

The injector 12 is shown mounted in an engine that was originally constructed to hold inclined fuel injectors of the right angle type, wherein the injector terminals extend at an incline that is most commonly 45° from the vertical. Other components lie closely enough above the injector that the connector 16 cannot be simply inserted vertically down. Applicant provides the adaptor 14 to enable the straight injector to be used in place of the inclined injector.

Figure 2:
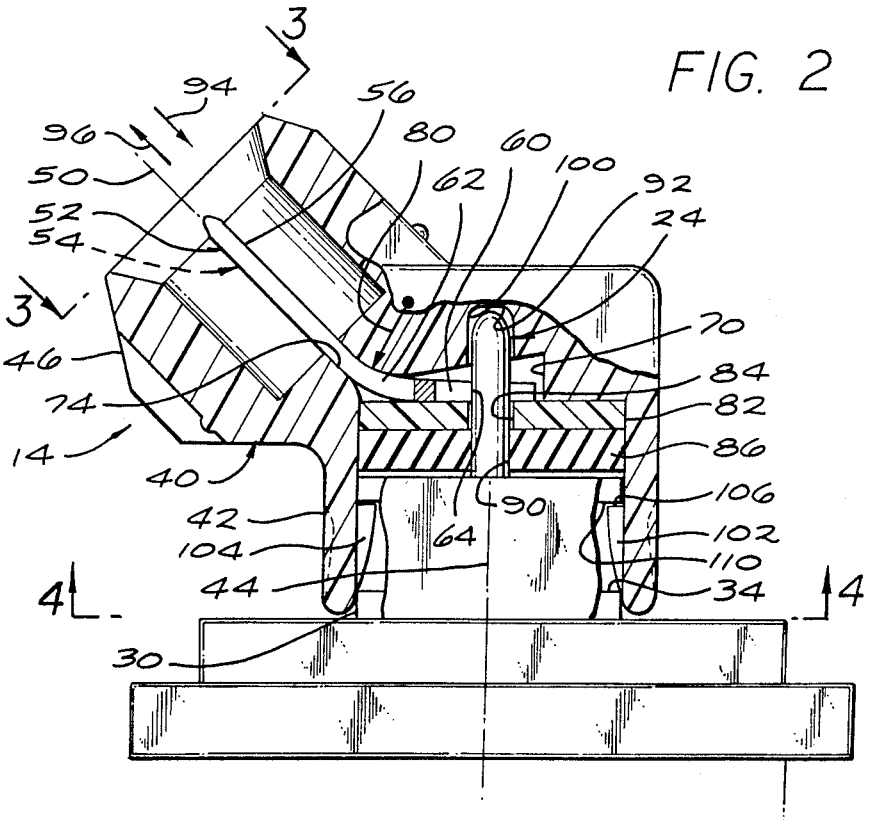
FIG. 2 is a sectional side view of an adaptor of FIG. 1 shown in its final mounted position on a fuel injector of FIG. 1.

As shown in FIG. 2, the adaptor 14 includes a housing 40 which has a lower part 42 that opens downwardly along a first axis 44, and has an upper part 46 that opens at an upward incline along a second axis 50. The second axis is angled by more than a few degrees from the first axis. The adaptor has a pair of contacts 52, 54 that each has an upper contact part 56 lying in the upper housing part 46 and extending substantially parallel to the inclined axis 50. Each contact also has a lower part 60 lying in the lower housing part 42 and extending substantially perpendicular to the downward axis 44. Each contact also has a bent middle part 62 lying between the upper and lower contact parts. The lower contact part has a terminal-receiving hole 64 that receives a terminal 24 of the fuel injector.

As shown in FIGS. 5 and 6, which show the contact 52 prior to bending, each contact is a plate-like element having a width W greater than its thickness T. The upper contact part 56 is of straight flat configuration without any holes, while the lower contact part 60 extends at an angle to the upper part and forms the terminal-receiving hole 64. The lower contact part has a slit 66 that allows locations on opposite sides of the hole to spread apart slightly to receive an injector terminal in interference fit therewith. As shown in FIG. 4, the lower adaptor housing part 42 has a pair of recesses 70, 72 which closely receive a corresponding contact lower part 60.

FIG. 7 shows a first step in the assembly of the adaptor 14. Initially, the two contacts such as 52 are projected through holes 74 in the adaptor housing, but with each contact such as 52 extending in a straight line as seen in the side view of FIG. 7. In a next step, the lower contact part 60 is bent upwardly into a corresponding recess 70. Each adaptor hole has an upper wall 76 which is curved at a large radius of curvature 80, the radius of curvature being at least half the length L of the lower contact part. As a result, bending of the contact after it is installed in the adaptor housing, does not result in a sharp bend and corresponding high stresses that might weaken the contact.

As shown in FIG. 2, after the contact has been bent, a locking plate 82 of hard insulative material having terminal-passing holes 84 is installed in the lower housing part 42. The locking plate preferably has a slight interference fit with the lower housing part so it holds itself in place. Then a rubber sealing plate 86 which has terminal-receiving holes 90, is installed under the locking plate. The adaptor is then ready for mounting on the top end of a fuel injector. It may be noted that, while applicant prefers to bend the contact with a special tool, it is also possible to bend the contacts by installation of the locking plate 82.

The adaptor is installed on the upper body end 30 of the fuel injector by inserting the upper body end into the adaptor lower housing part. The injector terminals such as 24 project through holes in the sealing and locking plates, through holes 64 in the contacts, and into terminal-receiving recesses 92 in the lower housing part. During projection of the terminals through the contact holes, the contact portions on opposite sides of each hole 64 spread apart slightly to make interference fit with the fuel injector terminals. The contact-receiving recesses such as 70 are wide enough to permit such spreading. Each contact such as 52 lies loosely in the adaptor housing in that it is held without solder, adhesive, or the like which would be difficult to use in the hot environment of an engine compartment, and without a crimping. However, the terminals securely hold the contacts in position.

The recesses such as 70 in the lower housing part surround the contacts closely enough that, in conjunction with the locking plate 82, the contacts are securely held until the adaptor is mounted on the injector. Until such mounting, large mating and unmating forces in the directions 94, 96 of a connector to the upper contact parts, could shift the contact position, with it being possible for a large unmating force to pull out the contacts partially. However, when a fuel injector terminal such as 24 projects through the contact hole 64, the terminal strongly resists movement of the contact along the mating and unmating directions 94, 96. The width B (FIG. 4) of the recess 70 that holds a contact lower part 60, is preferably narrow enough that the contact parts on opposite sides of the contact hole cannot spread apart far enough to withdraw from the injector terminal so as to allow the contact to pull out of the adaptor housing. It may be noted in FIG. 2, that the walls of the terminal-receiving recess 92 surround the terminal closely enough that one of the recess walls 100 can support the terminal against bending if the contact is pulled out in the unmating direction 96.

Referring to FIG. 4, it can be seen that each contact has a bent form as seen in a bottom or plan view, that results in the holes 64 of the lower contact parts being spaced apart by a distance C which is greater than the spacing D of the center lines of the upper contact parts. Thus, the sturdy plate-like contacts serve not only to engage terminals at different orientations (one extending vertically and the other at a 45° angle to the vertical) but also serve to engage pairs of terminals at different spacings.

It is highly desirable that once the adaptor is installed on an injector, that it be permanently held in place. This prevents movement of the contacts if the adaptor were to be pulled off the fuel injector before unmating from a harness connector. As shown in FIG. 2, applicant utilizes the adjusting holes 34 in the injector connector end 30 to lock the adaptor in place. After applicant inserts the injector connector end 30 into the adaptor housing lower part, applicant deforms opposite sides of the adaptor lower housing part to form inwardly-projecting latch dogs or tines 102, 104. A thermoplastic adaptor housing can be heated to facilitate such deformation. The tines form upwardly-facing shoulders 106 that can abut corresponding shoulders 110 on the walls of the adjusting holes 34, to prevent lifting off of the adaptor. It would be possible to form the inwardly-projecting tines 102, 104 before installing the adaptor, but this would require making the adaptor housing more resilient, which would increase cost and reduce reliability, especially in a hot engine compartment environment.

Thus, the invention provides an adaptor for mounting on a straight fuel injector to enable coupling to an inclined connector, which is of simple and low cost construction and yet which can withstand the high temperatures of an engine environment. The adaptor includes a downwardly-facing housing part and an upwardly-inclined housing part, and includes a pair of contacts extending through holes in the connector to lie in both housing parts. The upper contact part extends along the inclined upper housing axis, while the lower housing part extends substantially perpendicular to the downwardly-extending lower housing axis. Each contact has a bent middle merging the opposite contact parts. When the adaptor is mounted on an injector, terminals of the injector project through holes in the lower contact parts to lock the contacts in place, to resist mating and unmating forces on the upper contact parts that could otherwise shift the contacts. The contacts can be temporarily held in place by a locking plate. Each contact is preferably formed of a plate-like element, and may be bent after installation so the lower contact parts are received in closely surrounding recesses of the lower housing part. The lower housing part can be permanently attached to an upper injector body end by tines formed in the lower housing part that project into adjusting holes that have been already left in the injector body end. It should be understood that terms describing the orientation of the parts such as "vertical", "inclined", and "upper and lower" are used to aid in understanding the invention as shown in the drawings, and that the parts can be used in other orientations with the terms describing the relative orientations of the parts.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A fuel injector adaptor for coupling the electrical terminals of a straight fuel injector to a connector that extends at an incline, comprising:

an adaptor housing which has a lower part that opens downwardly along a first axis and an upper part that opens at an upward incline along a second axis;

a pair of plate-like contacts each having an upper contact part lying in said upper housing part and extending substantially parallel to said second axis, and having a lower contact part lying in said lower housing part and extending substantially perpendicular to said first axis, each lower contact part having walls forming a hole for receiving a fuel injector terminal, and each contact having a bent middle part.

2. The adaptor described in claim 1 including:

a straight fuel injector having an insulative body end lying in said lower housing part, and having a pair of terminals projecting through said holes in said lower contact part and lying in interference fit with said contact hole walls;

said contacts lying loosely in said housing except that they are tightly held by said injector terminals.

3. The adaptor described in claim 1 including:

a straight fuel injector having a body with an insulative body end, and having a pair of injector terminals projecting from said body end, said body end having opposite sides and having an adjusting hole in each of said sides;

said adaptor housing lower part lies around said insulative body end and has a pair of inwardly-projecting tines that are receive in said adjusting holes and that prevent removal of said adaptor from said injector.

4. The adaptor described in claim 1 wherein:

said bent middle part of each contact has a radius of curvature along the bend, which is at least about half the length of said lower contact part.

5. The adaptor described in claim 1 including:

a locking plate lying in said lower housing part, substantially facewise against said lower contact parts, for holding said lower contact parts in said housing, said plate having holes for passing each of said injector terminals.

6. The adaptor described in claim 1 wherein:

said lower housing part has walls forming a pair of recesses that each closely surrounds the lower part of one of said contacts to maintain the position of the lower contact part.

7. The adaptor described in claim 6 wherein:

each of said contact lower parts has a split end with one of said holes lying therealong, and said recess walls lie closely enough on either side of said split end that when an injector terminal projects in interference contact through said hole the recess walls prevent the split from widening enough to allow the contact to be pulled out around the terminal.

8. A combination of a straight fuel injector, and an adaptor which can connect to a connector having a pair of terminals for connection to an inclined fuel injector, comprising:

a fuel injector having a body with an insulative body upper end, and having a pair of electrical pin terminals projecting upwardly from said body upper end;

an adaptor housing which includes a lower housing part that opens downwardly along a first axis, and an upper housing part that opens at an upward incline along a second axis;

a pair of contacts lying in said adaptor housing, each contact having an upper part lying in said upper housing part and extending substantially parallel to said second axis and a lower contact part lying in said lower housing part and extending substantially perpendicular to said first axis, each lower contact part having a terminal-receiving hole;

each contact being in the form of a plate with a bent middle, with said upper contact parts spaced apart by a first spacing to match said connector terminals and with said terminal receiving holes spaced apart by a second distance different from said first distance to match the spacing of said injector terminals;

said lower housing part having a pair of recesses with walls that closely surround said lower contact parts;

said lower housing part receiving said body upper end and being permanently locked thereto, with said injector terminals received in said contact holes.

9. A method for constructing a fuel injector adaptor that can couple the electrical terminals of a straight fuel injector to a connector that extends at an incline, comprising:

forming an adaptor housing with a lower part that opens downwardly along a first axis, with an upper part that opens at an upward incline along a second axis, and with a pair of contact-passing holes extending between said lower and upper parts;

establishing a pair of substantially flat plate-like contacts that each has upper and lower parts, with the lower contact part having a terminal-receiving hole, in said contact passing holes, with the upper contact part lying in said upper housing part and extending parallel to said second axis and with the lower contact part lying in said lower housing part and extending substantially perpendicular to said first axis;

pressing said lower housing part onto said fuel injector and locking said lower housing part thereon, with said fuel injector terminals projecting through said terminal-receiving holes in said contact.

10. The method described in claim 9 wherein:

said step of establishing the lower contact part of each contact includes initially positioning each contact so it lies in a substantially flat configuration in said housing with said lower contact part extending substantially parallel to said second axis as seen in a side view, and then pressing up on said lower contact part to bend said contact until said contact lower part extends substantially perpendicular to said first axis.

11. The method described in claim 9 wherein:

said fuel injector includes a body with an insulative body top end, said terminals projecting from said body top end, and said body top end having opposite sides and an adjusting hole in each of said sides;

said step of pressing and locking said adaptor lower housing part onto said fuel injector includes first installing said lower housing part around said body top end and then deforming opposite sides of said lower housing part into said adjusting holes.

* * * * *